United States Patent [19]

Straitz, III

[11] 4,147,493

[45] Apr. 3, 1979

[54] IGNITER FOR FLARES

[75] Inventor: John F. Straitz, III, Elkins Park, Pa.

[73] Assignee: Combustion Unlimited Incorporated, Jenkintown, Pa.

[21] Appl. No.: 848,075

[22] Filed: Nov. 3, 1977

[51] Int. Cl.[2] ..... F23D 13/20

[52] U.S. Cl. ..... 431/15; 431/202; 431/153; 431/264

[58] Field of Search ..... 431/15, 153, 202, 264

[56] References Cited

U.S. PATENT DOCUMENTS

| | | | |
|---|---|---|---|
| 2,806,518 | 9/1957 | Poole et al. | 431/264 |
| 2,888,981 | 6/1959 | Ripple | 431/202 |
| 3,697,229 | 10/1972 | Frey et al. | 431/202 |
| 3,756,765 | 9/1973 | Sparrow et al. | 431/202 |

FOREIGN PATENT DOCUMENTS

| | | | |
|---|---|---|---|
| 1011558 | 4/1957 | Fed. Rep. of Germany | 431/202 |

*Primary Examiner*—Carroll B. Dority, Jr.
*Attorney, Agent, or Firm*—Zachary T. Wobensmith, 2nd; Zachary T. Wobensmith, III

[57] ABSTRACT

An igniter for flares is disclosed which includes one or more spark electrode carriers movable by a cable toward and away from the top of the flare stack and with indicating and control apparatus preferably near or remote from the base of the flare stack controlling the energization of the electrodes when they are at the top of the flare stack by temperature sensing elements on the electrode carriers, the sensing elements indicating presence or absence of flame at the top of the stack and with indicators of spark failure. Provisions for reset of the timers is also provided.

14 Claims, 5 Drawing Figures

IGNITER FOR FLARES

BACKGROUND OF THE INVENTION

1. Field of the Invention

This invention relates to igniters for flare stacks and the like.

2. Brief Description of the Prior Art

It has heretofore been proposed to ignite flares to which combustible waste gas is delivered and various devices have been proposed.

It has heretofore been proposed as in the U.S. Pats. Nos. to Kuhn, 2,460,016, Zink, 2,869,631, Rodman et al., 3,537,091 and Straitz, 3,816,059 to ignite a pilot or the like by employing a flame front generator. These igniters require a continuous supply of combustible gas under pressure for the pilots which involves continued expenditure of energy. For some applications combustible gas for pilots may not be available.

Ripple in U.S. Pat. No. 2,888,981 and Haberle et al., in U.S. Pat. No. 2,734,562, show resistance heating elements or hot wires which are inaccessible, and by reason of continuous exposure to the flame require frequent maintenance, are subject to carbon deposits resulting in failure and have short operating lives.

The structure of the present invention is not subject to the shortcomings of the prior igniters and can be easily installed and maintained.

SUMMARY OF THE INVENTION

In accordance with the invention an igniter for flare stacks is provided which comprises an igniter unit which can be moved to a position for ignition as required, the igniter unit preferably having spaced electrodes and a heat sensing element for shut off, the unit preferably containing a transformer which is protected from the heat of combustion of the waste gases and which has contacts for energizing the electrodes and for connection to the heat sensing element when it is in its uppermost position. Indicators are also provided as to the flame and the failure of sparking at the electrodes or shorting of the electrodes.

It is the principal object of the invention to provide igniters for flares which are simple in construction, effective in operation and free from operating difficulties, and which do not require any supply of pilot gas.

It is a further object of the invention to provide igniters for flares which are self-checking and indicate ignition system failure.

It is a further object of the invention to provide igniters for flares which conserve energy.

It is a further object of the invention to provide igniters for flares in which a readily accessible igniter unit is employed and which can be easily inspected if desired.

It is a further object of the invention to provide an igniter for flares in which the indication and control components are located on the ground for accessibility.

Other objects and advantageous features of the invention will be apparent from the description and claims.

BRIEF DESCRIPTION OF THE DRAWINGS

The nature and characteristic features of the invention will be more readily understood from the following description taken in connection with the accompanying drawings forming part hereof in which.

Figure 2:
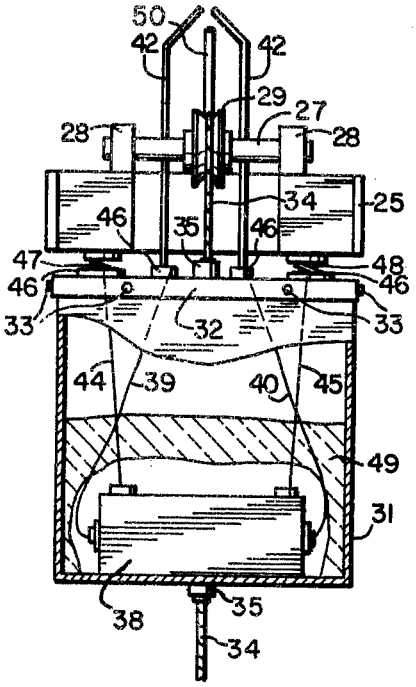
FIG. 2 is an enlarged view in elevation of an igniter unit, parts being broken away to show the interior.
Figure 1:
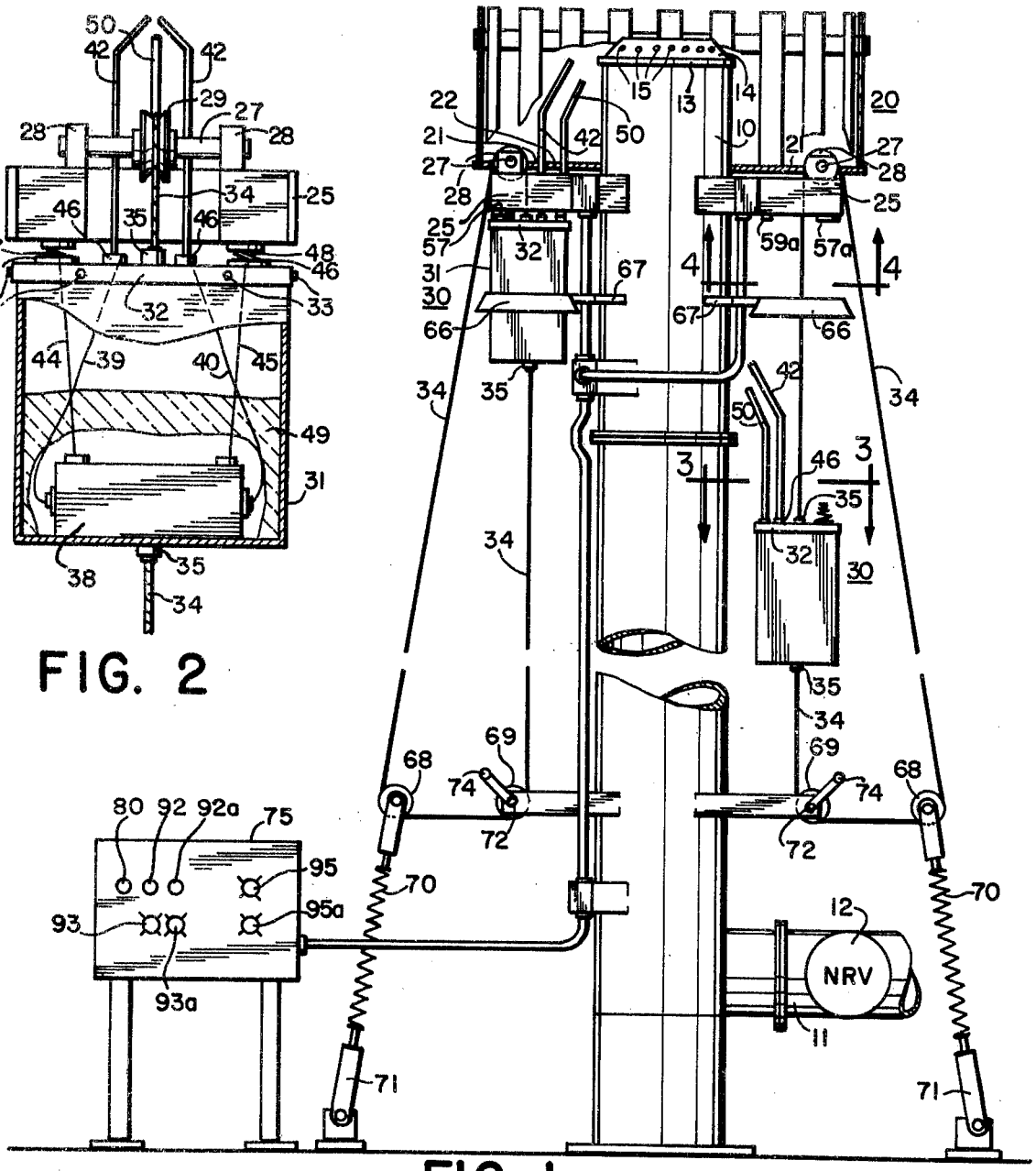
FIG. 1 is a view in elevation of a flare stack having igniters in accordance with the invention mounted thereon.
Figure 3:
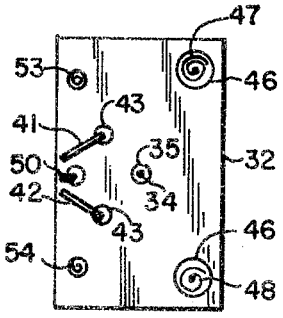
FIG. 3 is a top plan view of the igniter unit shown in FIG. 2.
Figure 4:
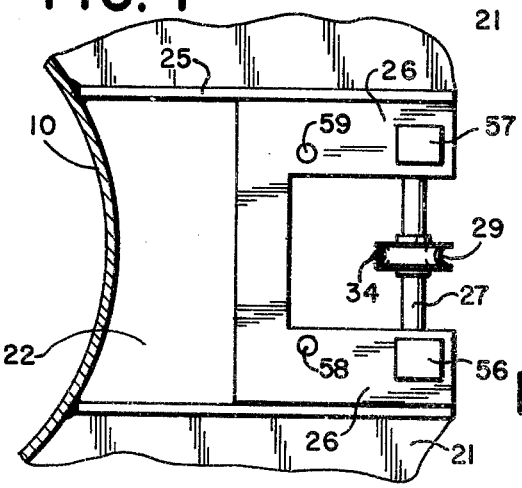
FIG. 4 is an underneath plan view showing a mounting bracket for the raising and lowering of the igniter unit and the electrical contacts carried on the bracket.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF THE PREFERRED EMBODIMENT

Referring now more particularly to FIGS. 1 to 4 of the drawings a flare stack 10 is shown diagrammatically to which waste combustible gas is supplied from a waste gas main 11 through a non-return or relief valve 12.

The waste combustible gas may be from oil drilling, gas production, gas pipe lines, oil refining or other chemical operations having combustible waste gas to be burned.

The stack 10 may be vertical or inclined for off-shore or on shore use, dependent upon the specific requirements, the stack 10 being shown as vertical.

The stack 10 is shown as having a flame retention ring with a flat burner ring 13 and a frusto conical burner ring 14 extending therefrom provided with openings 15 for discharge of gas for flame retention and with a central discharge opening 16.

A hollow cylindrical slotted windshield 20 is provided at the top of the stack 10, the windshield 20 being closed by a bottom wall or floor 21 except for openings 22 for the igniters.

The stack 10 is provided with igniters to be described, the number of igniters being determined by the diameter of the stack 10. For purposes of illustration, two igniters are shown.

Each of igniter preferably has a mounting bracket 25 which is secured to the stack 10 in any desired manner. The mounting bracket 25 has spaced outwardly extending arms 26 which support a shaft 27 in bearing blocks 28. The shaft 27 has a cable pulley 29 thereon.

An igniter unit 30 is provided, having certain of its components enclosed in a box 31. The box 31 may have a removable lid 32 held in place by studs 33. A cable 34 is detachably connected by connectors 35 to the top and bottom of the box 31.

Within the box 31 a transformer 38 is provided having output conductors 39 and 40 connected to sparking electrodes 41 and 42 supported in insulators 43 which are secured to the lid 32. The input conductors 44 and 45 to the transformer 38 are connected through insulators 46 to conical spring contacts 47 and 48. Within the box 31 heat insulating material 49 may be provided to protect the transformer 38 from the heat of combustion.

A thermocouple holder tube 50 is mounted on the lid 32 with a viewing opening (not shown) through which the thermocouple is exposed for sensing the flame at the top of the stack 10.

The thermocouple conductors (not shown) from the holder tube 50 are connected within the box 31 to insulated conical spring contacts 53 and 54 which are mounted on the exterior of the lid 32.

The arms 26 of the mounting bracket 25 have mounted on the lower faces thereof contact plates 56 and 57 for engagement respectively by the contacts 47 and 48 for energizing the electrodes 41 and 42, and contact plates 58 and 59 for engagement respectively by the contacts 53 and 54 for thermocouple signal transfer thereto.

The contact plates 56 and 57 are connected to conductors 60 and 61 for the unit just described and corresponding contact plates **56*a* and 57*a* for the other igniter are connected to conductors 60*a* and 61*a***.

The contact plates 58 and 59 are connected to conductors 63 and 64 for the unit just described and corresponding contacts **53*a* and 54*a* for the other igniter are connected to conductors 63*a* and 64*a***.

Guide collars 66 are preferably provided carried on brackets 67 secured to the stack 10 to guide the boxes 31 for contact engagement.

Each cable 34 extending from its upper cable connector 35 on the lid 32 and over the pulley 29, extends downwardly around a pulley 68 and then around a pulley 69 and to the cable connector 35 on the bottom of the box 31.

The pulley 68 is preferably connected through a cable tightening spring 70 and anchor 71. The pulley 69 is mounted on a shaft 72 carried by a bracket 73 and the shaft 72 preferably has a hand crank 74 thereon for moving the cable 34 in the desired direction to raise or lower the ignition unit 30.

A control box 75, preferably accessible at the base of or remote from the stack 10, preferably has the structure shown in FIG. 9 contained therein, and with signal lamps and manual controls exteriorly accessible as hereinafter explained.

Figure 5:
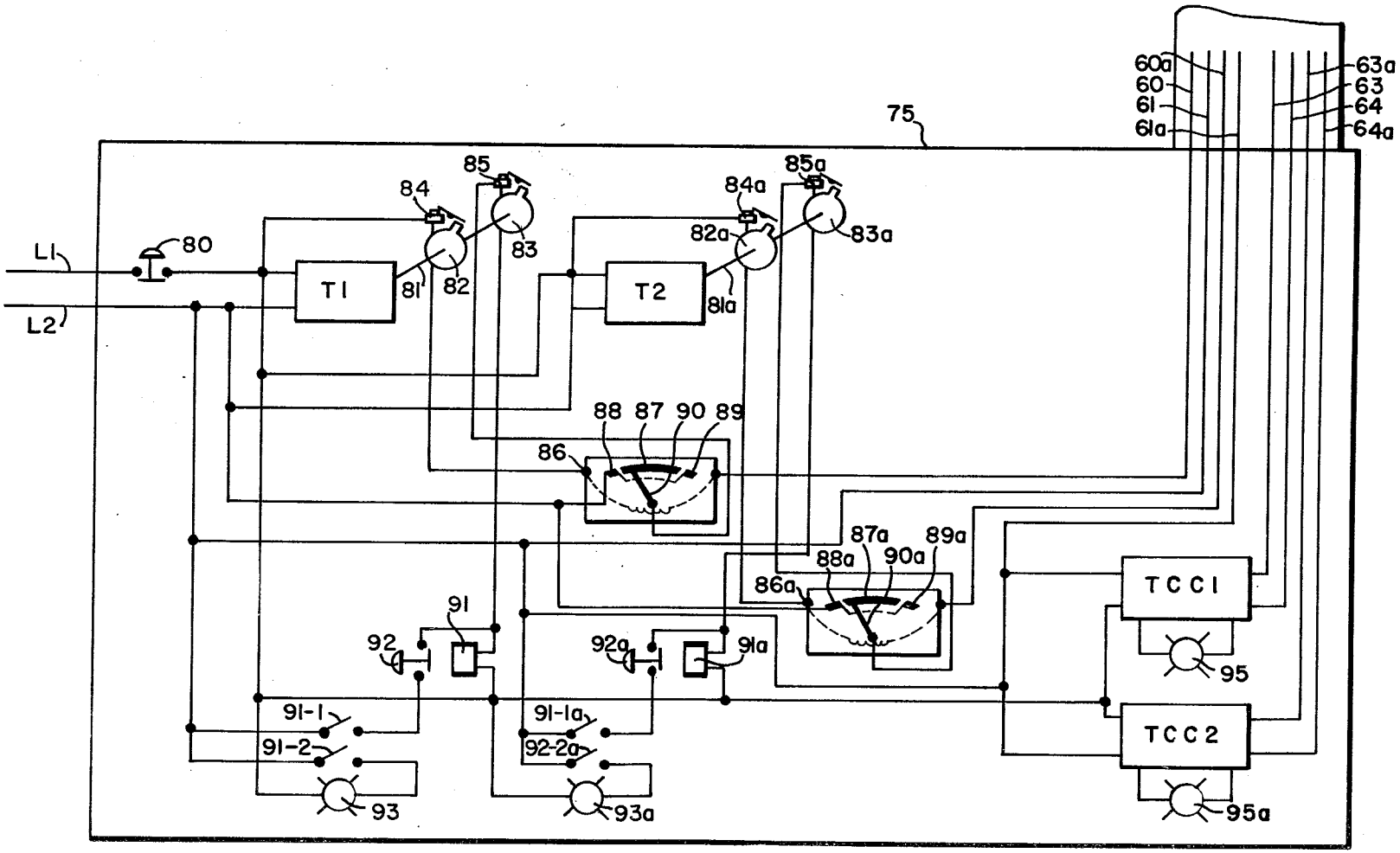
FIG. 5 is a diagrammatic view of the indicating and controlling elements for energization of the ignition electrodes.

Referring now to FIG. 5, power input leads L1 and L2 are provided. The lead L1 is connected through a manually operable on-off switch 80 which is accessible on the front of the control box 75 and is connected to a timer motor T1 for one of igniters which drives a shaft 81 for driving switch actuating cams 82 and 83. The cams 82 and 83 actuate switches 84 and 85. The switch 84 is periodically closed by the cam 82 to intermittently provide a spark at the electrodes 42 and is connected to an ammeter 86 for checking spark performance. The switch 84 is connected through the ammeter 86 to the conductor 60, the conductor 61 being connected to the lead L2.

The ammeter 86 has an intermediate selected operating range 87 with a low limit contact 88 and a high limit contact 89 connected to the contact 88 for engagement by the pointer 90 at either limit position. The pointer 90 is connected through the switch 85 which is actuated by the cam 83 to allow the signal from pointer 90 to continue only during sparking. This is controlled by cam 83 which has slightly shorter duration of switch actuation than cam 82 thus allowing the pointer 90 to reach the range 87 without giving a false signal. The switch 85 is closed slightly after the spark is energized through switch 84 and switch 85 is opened slightly before the spark is shut off by the switch 84.

The switch 85 also controls the actuation of winding 91 which in turn controls the contacts 91-1 and 91-2.

The self-latching contact 91-1 has a reset pushbutton 92 bypassed therearound and the contact 90-2 controls a lamp 93 in the event of spark failure of its igniter.

The lead L1 is also connected to a timer motor T2 for the other of the igniters which drives a shaft **81*a* for driving switch actuating cams 82*a* and 83*a*. The cams 82*a* and 83*a* actuate switches 84*a* and 85*a*. The switch 84*a* is connected to an ammeter 86*a* which is similar to the ammeter 86, and therethrough to the conductor 60*a*, the conductor 61*a* being connected to the lead L2**.

The cams **82*a* and 83*a* are like the cams 82 and 83** previously described.

The ammeter **86*a* for the other of the igniters also has an intermediate selected operating range 87*a* with a low limit contact 88*a* and a high limit contact 89*a* connected to the contact 88*a* for engagement by the pointer 90*a* in either limit position. The pointer 90*a* is connected through the switch 85*a* which is actuated by the cam 83*a* to allow the signal from the pointer 90*a* to continue only during sparking. This is controlled by the cams 82*a* and 83*a* which are like the cams 82 and 83** previously described, and in the same manner.

The switch **85*a* also controls the actuation of the winding 91*a* which in turn controls the contacts 91-1*a* and 91-2*a***.

The self-latching contact **91-1*a* has a reset pushbutton 92*a* bypassed therearound and the contact 91-2*a* controls a lamp 93*a*** in the event of spark failure of its igniter.

The thermocouple conductors 63 and 64 for the first igniter unit are connected to a thermocouple controlled relay TCC1 for energization of a signal lamp 95 to indicate that the flame is effective at the location of its thermocouple.

The thermocouple conductors **63*a* and 64*a* for the other igniter unit are connected to a thermocouple controlled relay TCC2 for energization of a signal lamp 95*a*** to indicate that the flame is effective at the location of its thermocouple.

The mode of operation will now be pointed out.

If it is desired to ignite combustible waste gas discharging from the stack 10 at least one of the igniter units 30, dependent on wind direction and velocity, is moved upwardly to bring its igniter spring contacts 47 and 48 into engagement with the contact plates 56 and 57 and its thermocouple spring contacts 53 and 54 into engagement with the contact plates 58 and 59 with its sparking electrodes 41 and 42 and the thermocouple holder tube 50 with its thermocouple close to the top of the stack 10.

Either before or after the igniter unit 30 is in its uppermost position the switch 80 is closed.

Since there is no burning at the top of the stack 10 at this stage no signals from the thermocouple in the holder tube 50 will be available to activate the signal lamp 95 and/or **95*a***.

The timer motors T1 and T2 will be activated to rotate the shafts 81 and **81*a* and their cams. For purposes of illustration reference will be had to the action of the timer motor T1 for one of the igniters since the action of the other timer motor T2** is the same for the other igniter.

The raised portion of the cam 82 completes a circuit through the switch 84 for a short time interval and to and through the conductors 60 and 61, the transformer 38 and through the contacts previously described to activate the sparking electrodes 41 and 42.

If the current through the ammeter 86 moves the pointer 90 to the operating range 87 this indicates normal sparking operation, without any alarm indication, controlled by switch 85, coil 91, contacts 91-1, 91-2 and indicator lamp 93.

The cam 83 allows the pointer 90 to come to its operating range 87 and is arranged to come on after the spark is started and to go off before the spark ends.

I claim:

1. An igniter for a flare stack comprising an igniter member having ignition electrodes extending therefrom, mounting means carried by the stack for selectively moving said igniter member to a position for igniting combustible gases discharging from the flare stack, said mounting means including a bracket carried on said stack, said igniter member having a cable member attached thereto for moving said igniter member to a position for ignition, and means for activating said electrodes.

2. An igniter as defined in claim 1 in which said igniter member has a transformer mounted therein.

3. An igniter as defined in claim 1 in which operating means is provided for said cable member, and tensioning members are provided for said cable member.

4. An igniter as defined in claim 1 in which a plurality of igniter members are provided for selective positioning at spaced locations at the discharge end of the flare stack.

5. An igniter as defined in claim 1 in which said activating means includes a timer motor, and cam members actuated by said motor for intermittent activation of said electrodes.

6. An igniter as defined in claim 5 in which a heat sensitive member is provided in spaced relation to said electrodes, and members are provided for activating said electrodes responsive to the condition of said heat sensitive member.

7. An igniter as defined in claim 6 in which an indicator member is provided responsive to the condition of said heat sensitive member.

8. An igniter as defined in claim 5 in which indicating means is provided responsive to the condition of said electrodes.

9. An igniter as defined in claim 1 in which said activating means includes members for intermittent activation of said electrodes.

10. An igniter as defined in claim 9 in which a heat sensitive member is provided in spaced relation to said electrodes, and members are provided for activating said electrodes responsive to said heat sensitive member.

11. An igniter as defined in claim 10 in which an indicator member is provided responsive to the condition of said heat sensitive member.

12. An igniter as defined in claim 9 in which indicating means is provided responsive to the condition of said electrodes.

13. An igniter as defined in claim 9 in which manual override means is provided for energization of said electrodes.

14. An igniter for a flare stack comprising an igniter member having ignition electrodes extending therefrom, said igniter member having a transformer mounted therein, mounting means carried by the stack for selectively moving said igniter member to a position for igniting combustible gases discharging from the flare stack, said igniter member and said mounting means having separable contact members engaged in a predetermined position of said igniter member for activation of said electrodes, and means for activating said electrodes.

* * * * *